US008136464B1

(12) United States Patent
Barbier et al.

(10) Patent No.: US 8,136,464 B1
(45) Date of Patent: Mar. 20, 2012

(54) C-FAST SYSTEM

(76) Inventors: Brian K. Barbier, Berwick, LA (US); Robert J. Scully, Jr., Berwick, LA (US); Frankie L. Yates, Raceland, LA (US)

( * ) Notice: Subject to any disclaimer, the term of this patent is extended or adjusted under 35 U.S.C. 154(b) by 257 days.

(21) Appl. No.: 12/365,977

(22) Filed: Feb. 5, 2009

Related U.S. Application Data

(60) Provisional application No. 61/089,666, filed on Aug. 18, 2008.

(51) Int. Cl.
*B63B 3/00* (2006.01)

(52) U.S. Cl. ..... 114/65 R; 114/79 W

(58) Field of Classification Search ..... 114/65 R, 114/79 W, 79 R
See application file for complete search history.

(56) References Cited

U.S. PATENT DOCUMENTS

| | | | | |
|---|---|---|---|---|
| 4,945,595 | A * | 8/1990 | Meriweather | 14/69.5 |
| 5,090,351 | A | 2/1992 | Goldbach et al. | |
| 5,313,903 | A | 5/1994 | Goldbach et al. | |
| 6,325,014 | B1 | 12/2001 | Blanchard | |
| 6,823,571 | B1 | 11/2004 | Ragland et al. | |
| 6,889,887 | B1 * | 5/2005 | Reeson | 228/49.1 |
| 7,261,932 | B2 * | 8/2007 | Kennedy | 428/156 |
| 7,891,308 | B2 | 2/2011 | Bianchi et al. | |
| 2002/0163173 | A1 * | 11/2002 | Ruehl et al. | 280/781 |
| 2005/0158562 | A1 * | 7/2005 | Kennedy | 428/423.1 |
| 2006/0037952 | A1 * | 2/2006 | Myers et al. | 219/130.51 |

FOREIGN PATENT DOCUMENTS

| | | |
|---|---|---|
| JP | 6135373 | 5/1994 |
| JP | 9234567 | 9/1997 |
| KR | 20030045705 | 6/2003 |

OTHER PUBLICATIONS

"Bruce Roberts Yacht Design"; www.bruceroberts.com/public/HTML/KIT-ASSEMBLY.htm; Published at least as early as Jul. 2008.

Fred Delaney, Stephan W. Kallee, Mike J. Russell; "Friction Stir Welding of Aluminum Ships"; Jun. 2007; Beijing, China.

"Bulletin No. 31"—Test Depth and High Yield; Published at least as early as Jul. 2008.

Lieutenant Matthew Miller; "Buffalo 286 and 292—Catastrophic Hull Failure in Two Laden Tank Barges"; www.shipstructure.org/buffalo.shtml; Published at least as early as Jul. 2008.

* cited by examiner

*Primary Examiner* — Stephen Avila
(74) *Attorney, Agent, or Firm* — Jones, Walker, Waechter, Poitevent, Carrere & Denegre L.L.P.

(57) ABSTRACT

A vessel constructed with a series of hull, bulkhead, and/or deck panels. The vessel includes a vessel frame and multi-panel sections attached to the frame. The multi-section panels include a plurality of elongated cold formed steel sections welded together. The sections include a flat segment and a web segment, where the flat segment is wider than the web segment. The multi-panel section is attached to the vessel frame and the flat segments form the hull, bulkhead, or deck of the vessel.

20 Claims, 11 Drawing Sheets

PRIOR ART DECK SECTION

PRIOR ART DECK SECTION

ROLL FORM LINE

PRESS BRAKE

C-FAST SHAPES

COMPLETED C-FAST SECTIONS

WELDING FIXTURE

DSW GANTRY/SAW PROCEDURE

BARGE APPLICATION EXAMPLE

ISOMETRIC SECTIONAL VIEW

C-FAST SYSTEM

This application claims the benefit under 35 USC §119(e) of U.S. provisional application No. 61/089,666 filed Aug. 18, 2008, which is incorporated by reference herein in its entirety.

TECHNICAL FIELD

This invention relates generally to methods and materials used for construction of structures including maritime vessels. In particular embodiments, the methods involve the combining of shaped sections to form panels for construction of maritime vessels and other structures.

BACKGROUND OF THE INVENTION

Many conventional processes for constructing structures from panels are very labor intensive. In one example of a conventional steel barge deck (FIGS. 1 and 2), the deck will consist of multiple parts. The plating (1) or surface of the deck may be cutout from stock millrun plates. These cut parts of the deck (1) may then be joined together and butt welded (2) to form a much larger deck panel. The next step is to place stiffening members (4) onto the plating (1) in accordance with the stiffener layout (3), spaced often enough to provide the strength as stipulated by the selected design. These stiffeners (4) are fitted to the plating (1) and forced tightly together to eliminate space between the stiffener and the plating. During this fitting process, the stiffeners are attached to the plating (1) via small temporary welds (tack welded) and checked with a squaring tool to insure right angle accuracy of 90 degrees (or as specified by the design). These stiffeners will then be welded along weld lines (6) by individual welders and/or machinery (7) in order to obtain the design strength of the stiffener/plating joint. This process may be repeated many times through the construction of a barge, not only for the example of a deck (FIGS. 1 and 2), but also potentially for bulkheads, sides, bottoms, flat panel walls, floors, roofs, walkways, or any sort of partition where the design requires stiffened panels.

DETAILED DESCRIPTION OF SELECTED EMBODIMENTS

Figure 1:
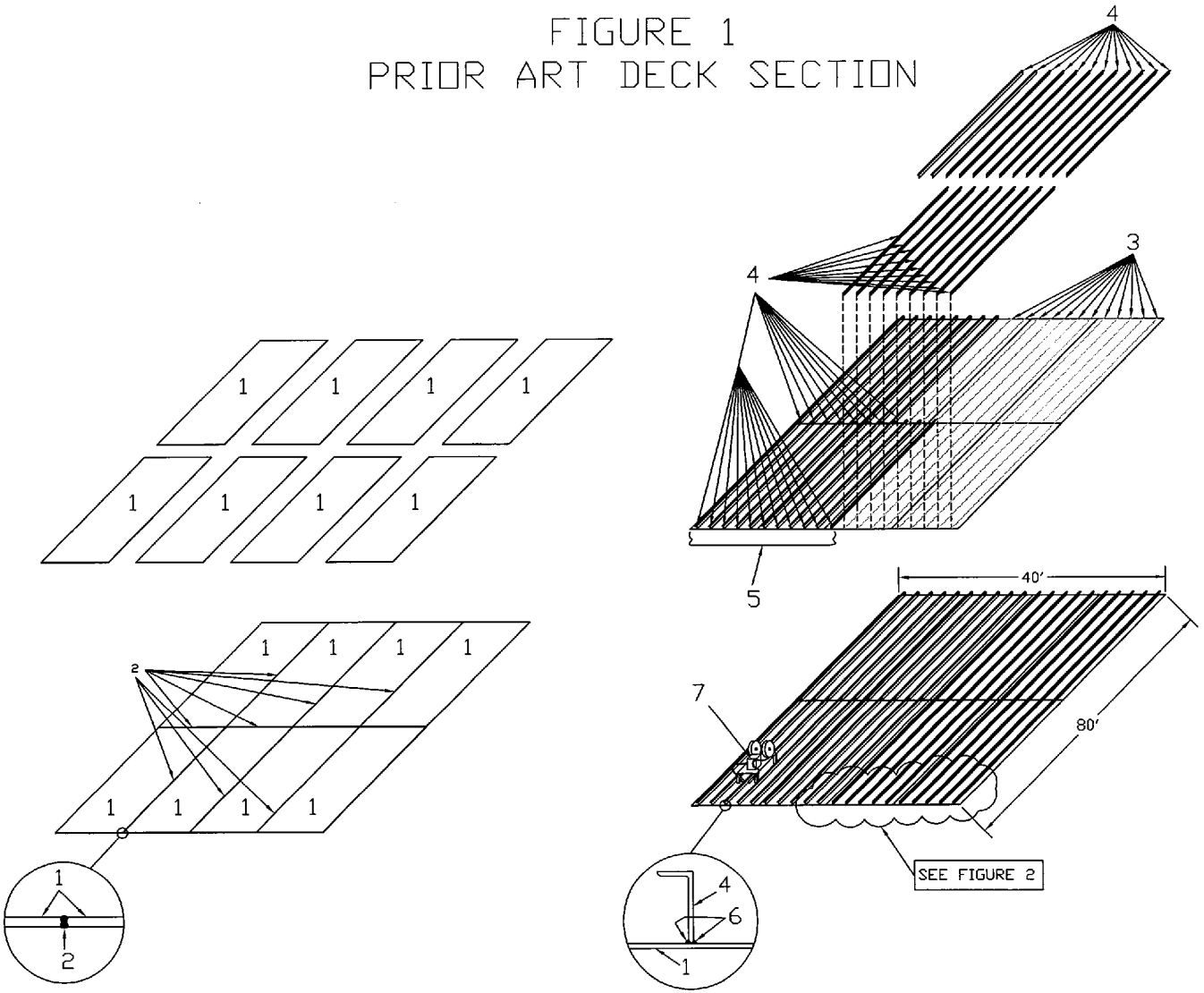
FIG. 1 is an isometric view suggesting one conventional method for producing a panel for a steel barge.
Figure 2:
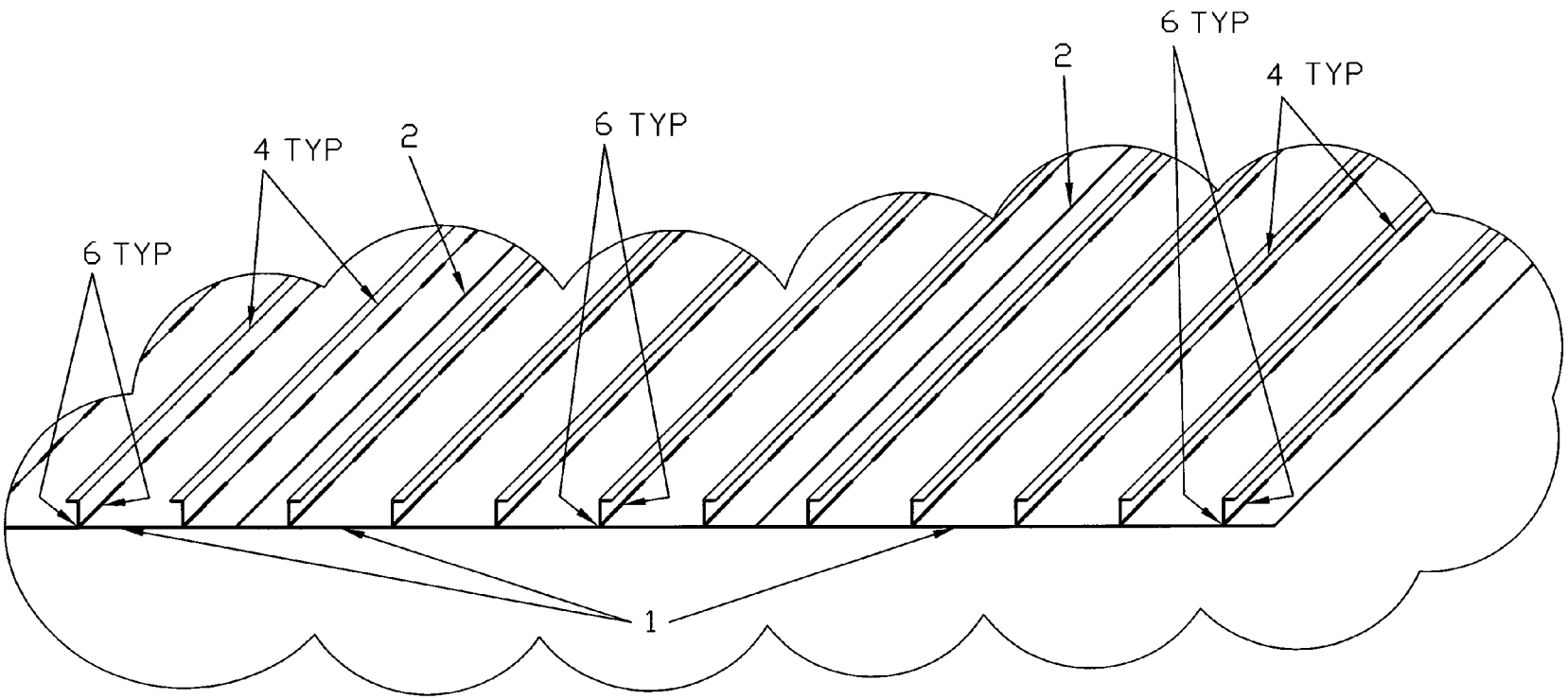
FIG. 2 is an isometric view of an enlarged section of the structure seen in FIG. 1.

Certain generalized embodiments of the invention provide an integral preformed section which consists of a stiffening element individually sized to suit design criteria and a flat panel surface element. One technique for producing these embodiments, which may be referred to as cold formed angle stiffening technology, provides a section of material, from any sort of metal that may be welded or fused together, which consists of integrally forming the stiffening element and the flat surface element without the need of a separate step to fasten the stiffener to the flat surface (i.e., because it is made from a unitary piece of material). This formed section may have a variable width equal to the desired stiffener spacing specified by any given design. The stiffening member of the formed section may also have a variable web height and flange width specified by the design. This technique may be used for the fabrication of flat panel decks, bulkheads, sides, bottoms, flat panel walls, floors, roofs, walkways (or any sort of partition) that is to be constructed from a metal that requires structural stiffening members to be combined with the flat panel for strength.

The overall section length is also variable, with one example having a length of up to 200 feet (but the length could be longer where allowed by manufacturing constraints). In some embodiments, as these sections are produced, they may be joined together along their long edges via a One Sided Welding (OSW) process. The OSW will produce a full penetration weld at each section's edge that joins another. This will produce a larger panel that will be inherently stiffened as the materials are joined (preferably on an automated assembly line). The design of a given vessel or other structure and/or the handling capabilities of the facility undertaking the assembly and erection of a given structure will be some of the factors influencing how many of the sections are used to manufacture a particular panel design. Using a maritime vessel as an example, larger panels may be used in the assembly of components such as decks, bulkheads, sides, bottoms, flat panel walls, floors, roofs, walkways, or any type of partition requiring stiffened panels. Furthermore, this embodiment may provide for connections such as side to bottom transitions that require a radial transition between the side and the bottom of a structure and also requiring a lapped connection to one or both long edges of the transition component and the side and/or bottom component.

As suggested above, one embodiment of the invention consists of a method of constructing a maritime vessel. This embodiment generally includes the steps of providing a plurality of elongated cold formed metal sections, welding the plurality of sections together to form a multi-section panel, and attaching the multi-section panel to a vessel frame. As used herein, "cold forming" or "cold formed" are items which are manufactured by a process in which metal is shaped at ambient temperature (or at temperatures sufficiently close to ambient temperature not to substantially alter the characteristics of the metal) in order to produce metal components to a close tolerance and net shape. Typically, cold forming imparts bending (tensile) forces to the metal being worked and includes a strain hardening effect which increases the yield strength in the bent segments. Cold forming as used herein excludes extrusion processes. In one embodiment, the cold forming is carried out by a roll forming process, i.e., a continuous bending operation in which a comparatively long strip of metal (often coiled steel) is passed through consecutive sets of rolls, or stands, each performing only an incremental part of the bend, until the desired cross-section profile is obtained.

Figure 3:
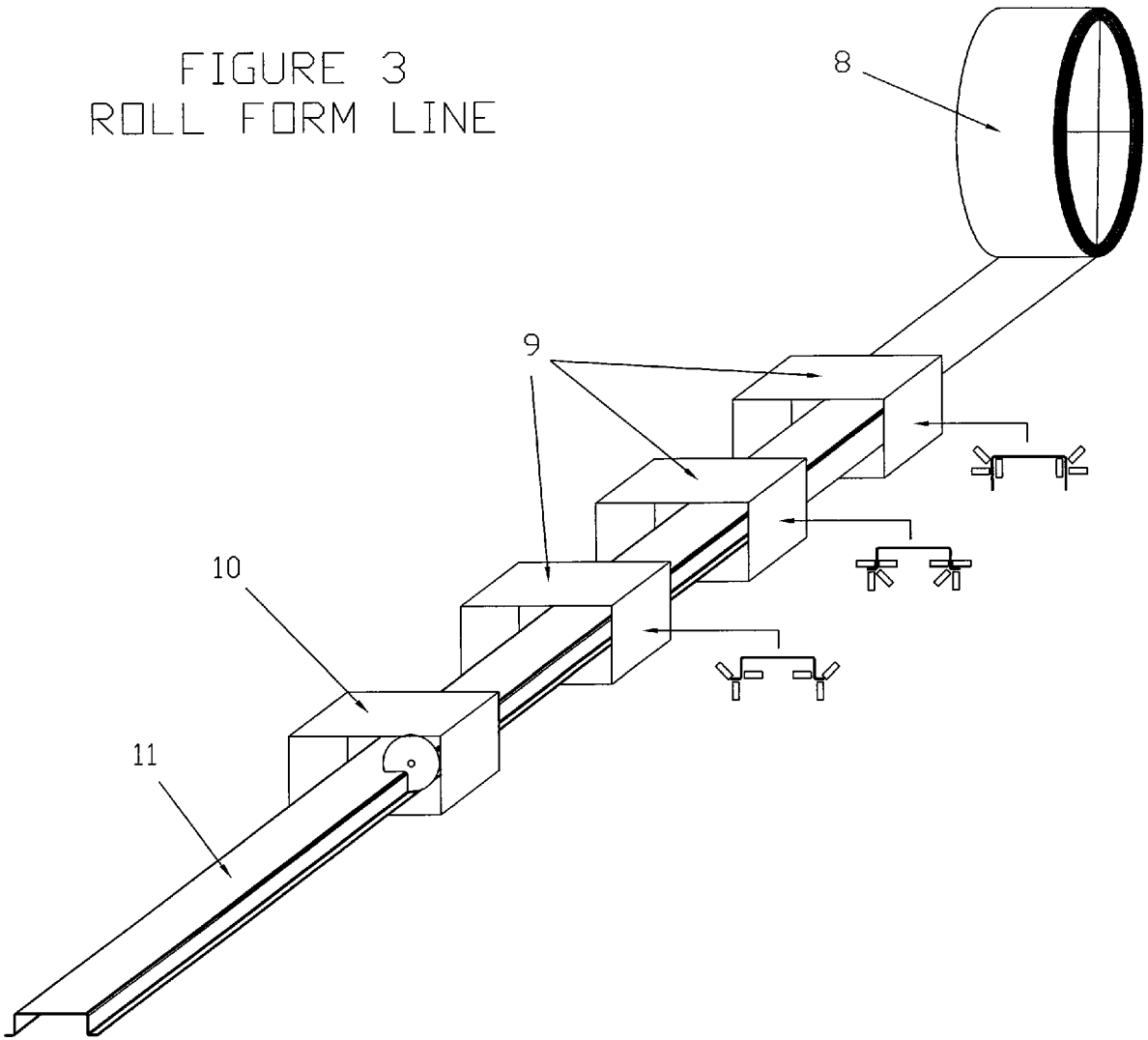
FIG. 3 is a schematic representation of the general processing steps of a roll form line.

FIG. 3 shows an isometric representation of a roll form line using coiled stock metal (8) conveyed through a series of power rollers (9). These power rollers (9) force the metal to bend into specific shapes referred to as sections (11) in the figures. Because of the use of coiled material (8) the length of the shapes can be specified to be of virtually any length; for example up to 200 feet long in this embodiment (but could be longer or shorter in other embodiments). As the section (11) progresses down the line, a friction saw (10) may cut the section at the desired length. Typically, the entire shape of the section is imparted by the cold forming process. However, in certain embodiments, the section may have an initial bend and curve and the final shape of the section is imparted by cold forming. Alternatively, part of the initial section shape may be imparted by cold forming the section and then the final shape imparted by some non-cold forming process. In either case, at least part of the shape in these alternate embodiments is imparted to the section by some cold forming process.

Figure 4:
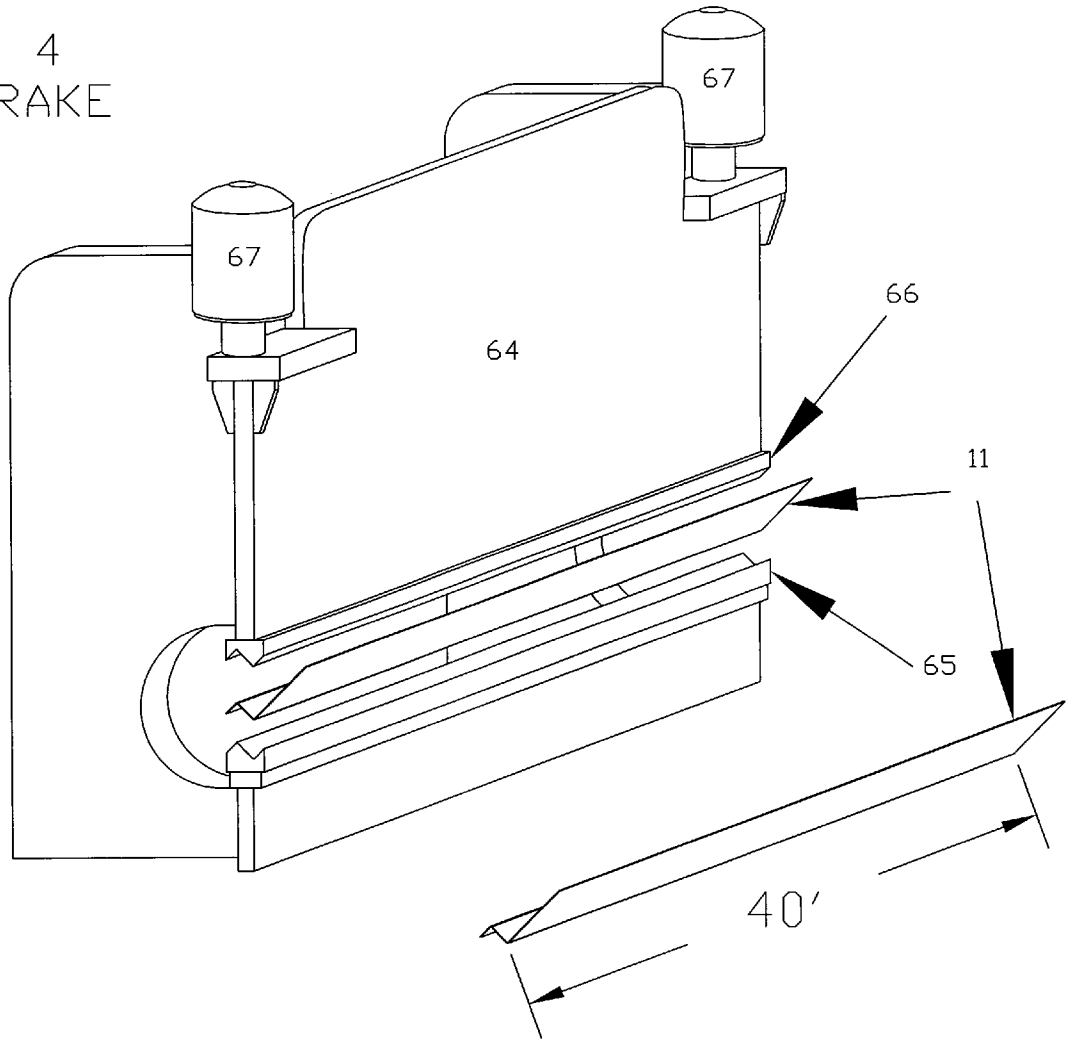
FIG. 4 is a schematic representation of press brake machine.

FIG. 4 suggests another cold forming technique which could be employed in shaping the sections. FIG. 4 schematically illustrates a press break apparatus (64). Press break (64) generally comprises die (65) and punch (66) which may be pressed together with great force by hydraulic cylinders (67). In the illustrated press break (64), die (65) has the desired shape of the final section (11) and punch (66) is the reverse shape, thus bending sections (11) into the desired shape when the sections are compressed between the die and punch. In a typical press break operation, the blank section material is precut to a desired length less than or approximately equal to the length of the press break die (65) and punch (66). The blank section of material is placed in between the die (65) and punch (66) and those elements are brought together with sufficient force to impart a cold formed bend to the blanks and create the final shaped section 11 (or a partially shaped section if the section is subject to a multi-step forming process). Although FIGS. 3 and 4 show two examples of cold forming processes, the invention is not limited to these methods and any other suitable method of cold forming may be employed. Furthermore, other embodiments may use shaping techniques other than cold forming to obtained the desired sections.

Figure 5:
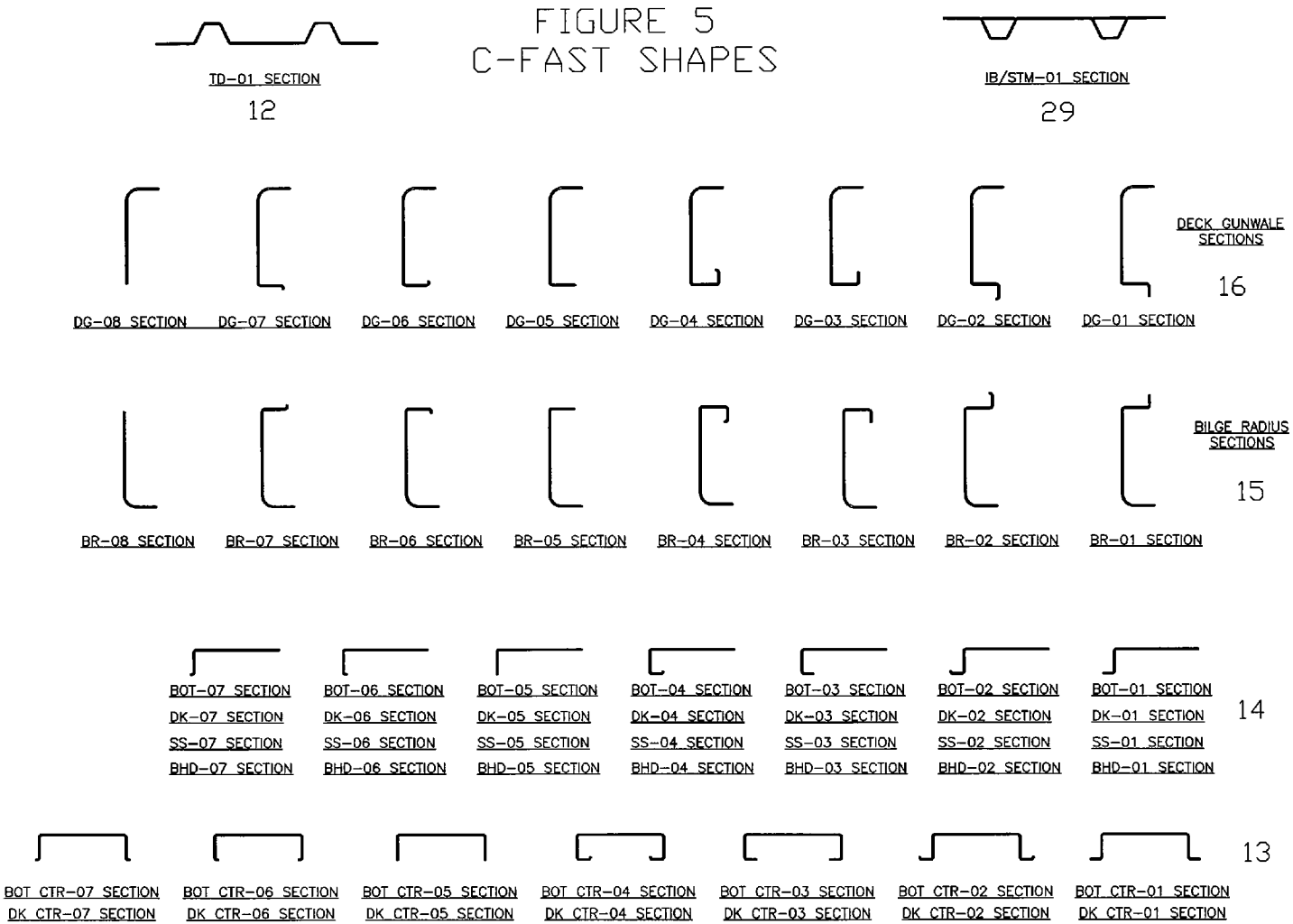
FIG. 5 represents example cross-sections which could be used for producing panels of various materials, configurations, and sizes.
Figure 6:
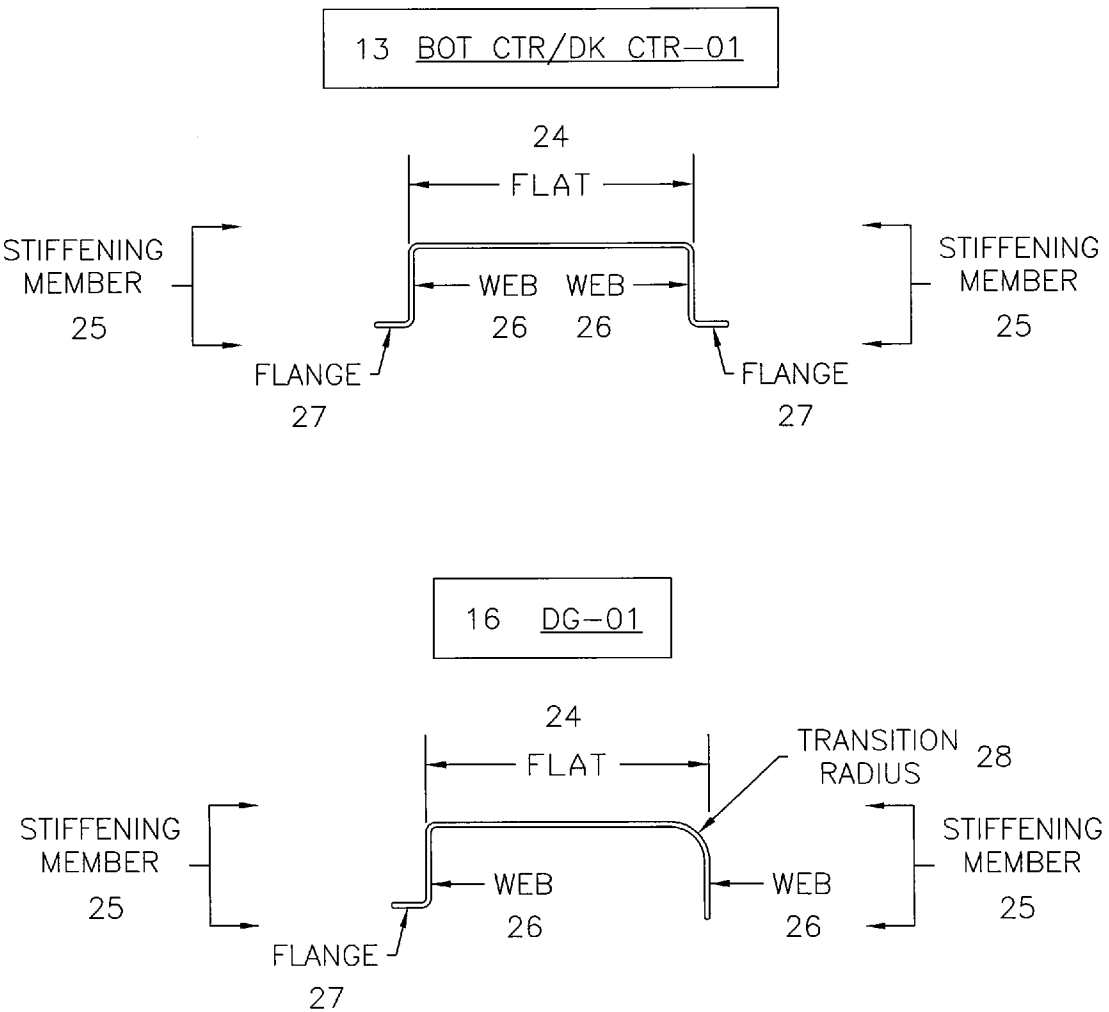
FIG. 6 is a graphic representation which identifies different parts of selected sections seen in FIG. 5.

FIG. 5 shows examples of various shapes into which the sections may be formed. In one example, these sections may be organized by groups such as: TD-01 (12); BOT CTR/DK CTR-01 through -07 (13); BOT/DK/SS/BHD-01 through -07 (14); BR-01 through -08 (15); DG-01 though -08 (16); and IB/STM-01 (29). These (or any other) sections may be used in any combination depending on finished sizes and design of a given project. As illustrated in FIG. 6 these formed sections may have a variable width referred to as a flat segment or "flat" (24) equal to the desired stiffener spacing specified by the particular design for a given project. The stiffening member (25) of the formed section will also have a variable web segment (26) height and flange segment (27) width specified by the design for a given project. In some sections, a radius may be used to accommodate a transition and may be referred to as "transition radius" (28) and is also variable depending on project design. A section having a transition radius may be referred to as transition section or component (e.g., deck gunwale section (16) and bilge radius section (15)).

The section length is also variable and in certain embodiments may be between about 20 feet and about 200 feet, but could be longer or shorter depending on design factors and the production/assembly facilities available. This could apply to any shape illustrated in FIG. 5 (or other shapes) and provides the flexibility to apply the methods to practically all types of metal flat panel constructions (see FIG. 10) such as, but not limited to, decks (20), sides (21), bulkheads (22), bottoms (23), flat panel walls, floors, roofs, walkways, or any type of partition requiring stiffened panels. In certain embodiments, the flat segment will be between about 12 inches and about 30 inches, and the thickness of the panels will be between about 1/16 inches and about 3/4 inches. Although many of the sections include a stiffening member (25) having both a web segment (26) and a flange segment (27) (see FIG. 6), certain sections will include a stiffening member (25) having only a web segment (26), see for example cross-section BR-08 (15). Some embodiments will have two web segments (26), two web segments (26) and one flange segment (27), or two web segments (26) combined with two flange segments (27). In many embodiments, the web segment is shorter than the flat segment (24) and in many embodiments having a flange segment (27), the flange segment (27) is shorter than the web segment (26) (although the flange and web segments could be equal lengths in other applications). As suggested by FIG. 6, the web segment (26) is typically generally perpendicular to the flat segment (24) and the flange segment (27) is generally perpendicular to web segment (26). However, exact perpendicular and parallel relationships may not be necessary in all embodiments.

In addition to maritime barges, certain embodiments of these methods may also apply to the construction of maritime motor vessels, offshore structures, living quarters, boxes, and containers, but the invention is not limited to a particular item so long as the item is constructed of the panels described or claimed herein.

Figure 7:
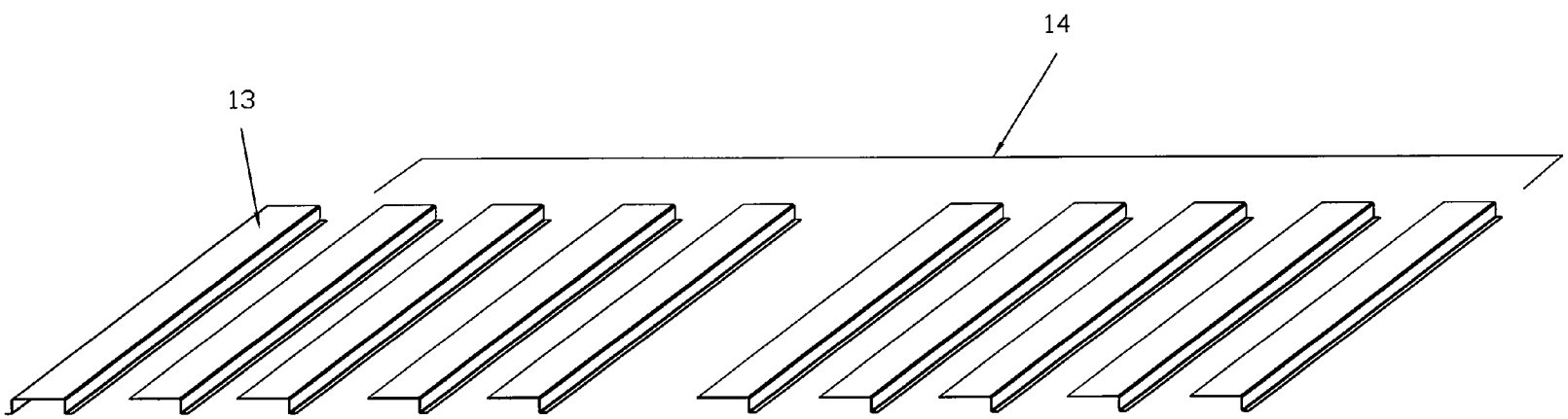
FIG. 7 is an isometric view of completed sections before setting into a fixture to be welded.
Figure 10:
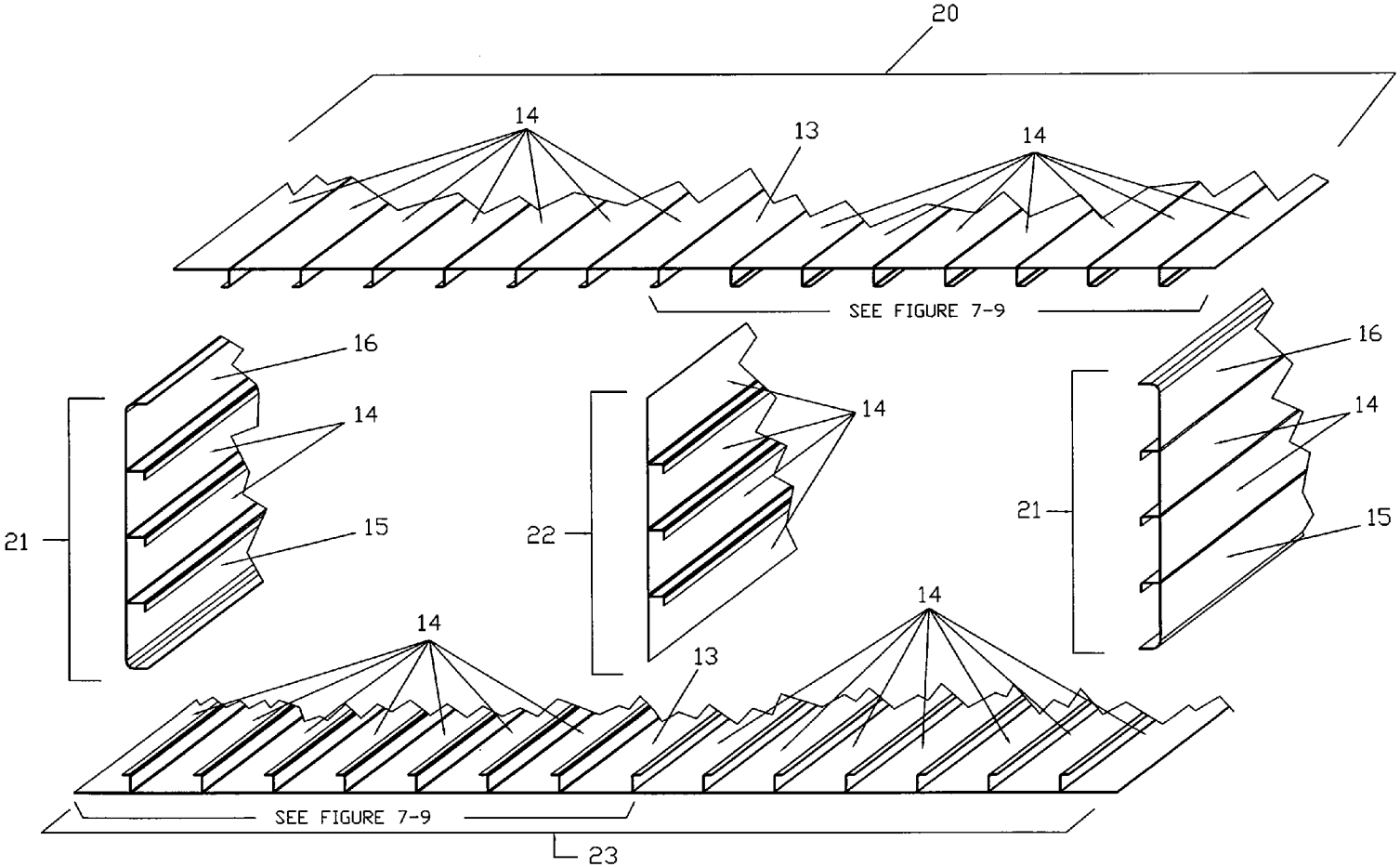
FIG. 10 is an isometric view of certain example applications of the panels and represents an example barge structure.

FIG. 7 shows one example of sections that could be employed to produce a deck panel (20) and/or bottom panel (23) as part of a barge construction (such as illustrated in FIG. 10). However, this illustration is intended to serve as but one example of the many applications of the products and/or techniques disclosed herein and does not limit, in any way, the use of the invention to the maritime barge industry. These selected sections would be sorted and prepared for placement (see FIG. 8) into a fixture (17) designed to hold each section in place for welding. Selected for this example panel are nine sections DK-01 (14) and one section DK CTR-01 (13) (see FIG. 5).

The panel sections could be constructed from any metal called for by a particular design, including various steels and aluminum alloys. As used herein "steel" means any grade of carbon steel or any grade of stainless steel. Nonlimiting examples of suitable carbon steels could include ASTM-A36, ASTM-A572, ASTM-A633, and API-2H while nonlimiting examples of stainless steels could include 304, 304-L, 316, and 316-L. The panels could be any suitable grade of aluminum or any suitable aluminum alloy, nonlimiting examples of which include 5086 and 6061. Likewise, the steels and aluminum alloys could be conventional or future developed metals.

Figure 8:
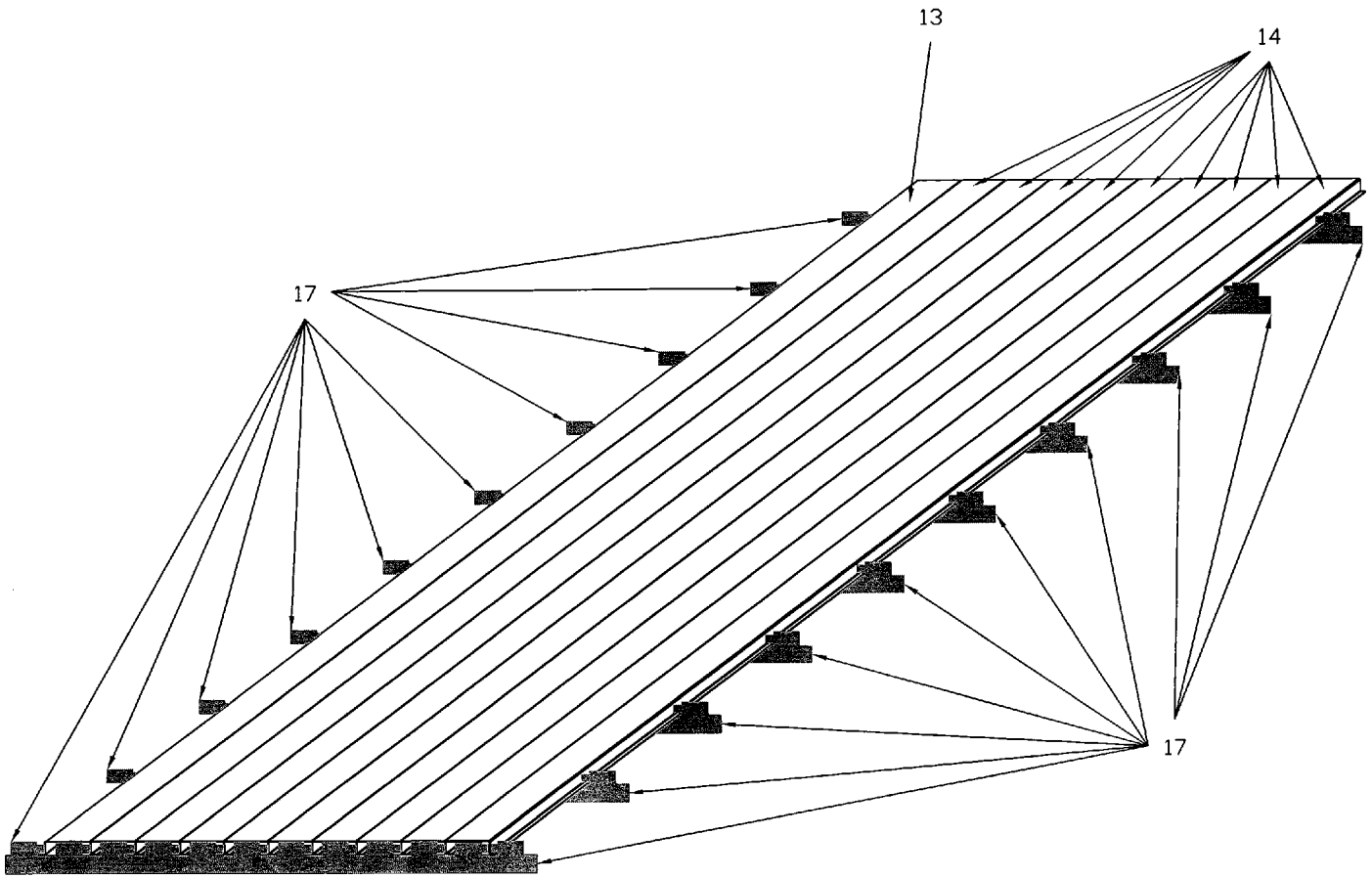
FIG. 8 is an isometric view of completed sections that have been set into a fixture to be welded.
Figure 9:
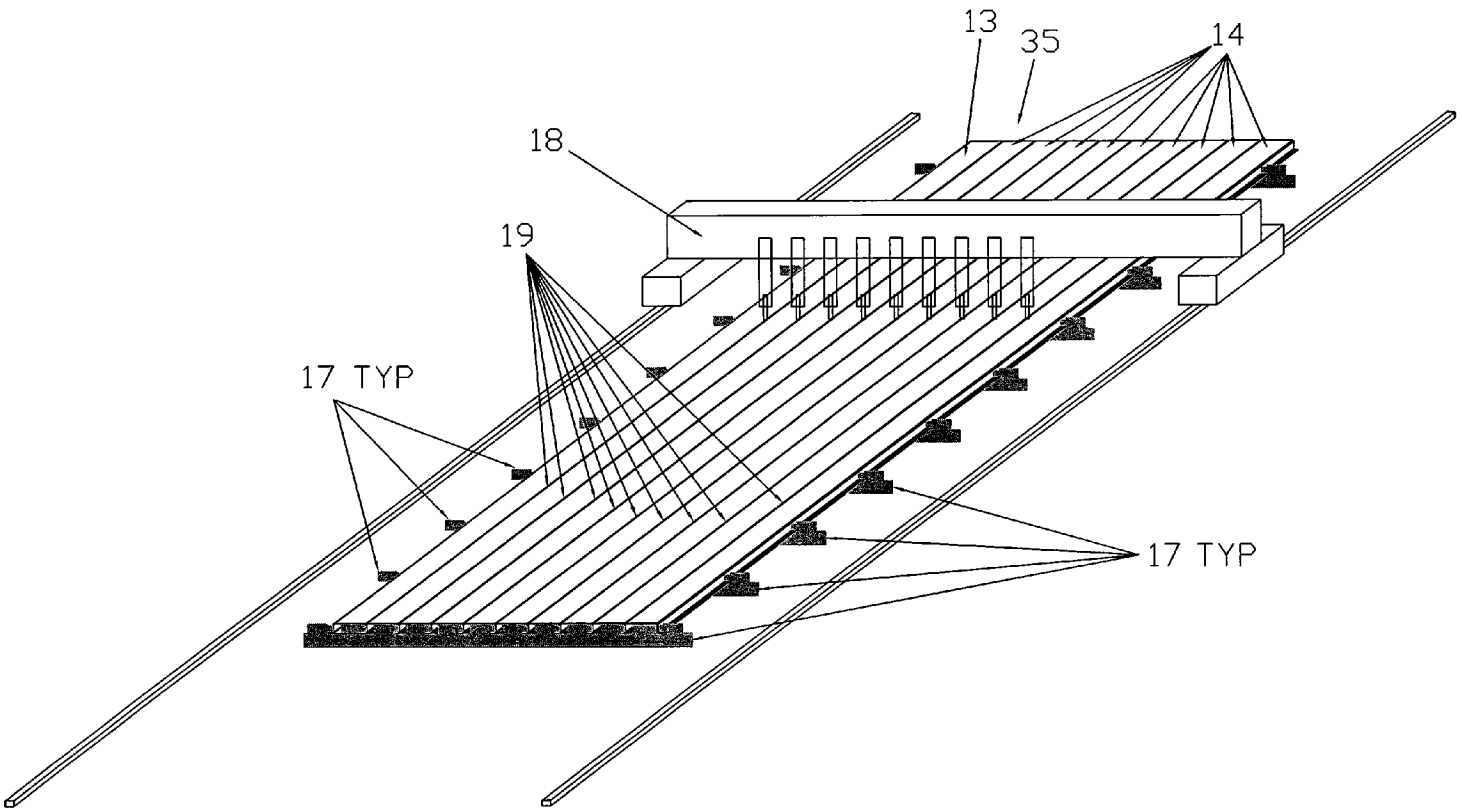
FIG. 9 is an isometric view of completed sections being welded to produce a 20 foot wide by 80 foot long panel.

FIG. 8 shows the nine C-FAST sections DK-01 (14) and one section DK CTR-01 (13) locked into the fixture (17) and ready for the welding process. FIG. 9 shows the nine sections DK-01 (14) and one section DK CTR-01 (13) being welded via a One Sided Welding gantry (referred to as an "OSW" (18)) capable of forming multiple welds (19) simultaneously. This OSW uses Submerged Arc Welding technology or SAW to produce multiple full penetration welds (19) from one side of the panel. These welds (19) will join the sections together creating a panel [or "multi-section panel" (35)]. In some designs, the length of the multi-section panels (35) will be up to about 200 feet long and vary between about 5 feet and about 20 feet in width, but the multi-section panels could be longer, wider or narrower in other embodiments. In this example the finished size of the multi-section panel (35) is 20 feet wide by 80 feet long and will be a portion of the deck on a common deck barge. This process will be repeated to produce the required number of panels needed to form the complete deck of the barge. These deck panels could be shipped to a receiving facility that will join the multiple panels together as the barge construction progresses. The joining of multi-section panels may create field welds or welds that are preferably provided by the assembling facility. These field welds could also be produced by SAW procedures via a portable SAW unit. The above steps and procedures may be repeated in the production of bulkhead, side, and bottom panels used in the example barge, as well as flat panel walls, floors, roofs, walkways, or any sort of partition requiring stiffened panels that may become a part of the construction of the barge or even other structures unrelated to the barge industry.

FIG. 10 illustrates the configuration of finished panels as used on example barge sections. The deck (20) is illustrated in the upper portion of the figure and the bottom (23) is illustrated in the lower portion of the figure. This exemplifies the use of the processed panels and their selected sections seen in FIGS. 7 to 9. Illustrated on each side of the barge is the use of the above described embodiments employing the same procedures, to produce the side panels (21). These side panels differ in that sections DG-01 (16) and BR-08 (15) have been selected as the upper and lower sections in the panel together with two inner parts of the sections SS-01 (14). In the center is illustrated a bulkhead (22) and the sections BHD-01 (14) that are joined together to produce the bulkhead panel.

Figure 11:
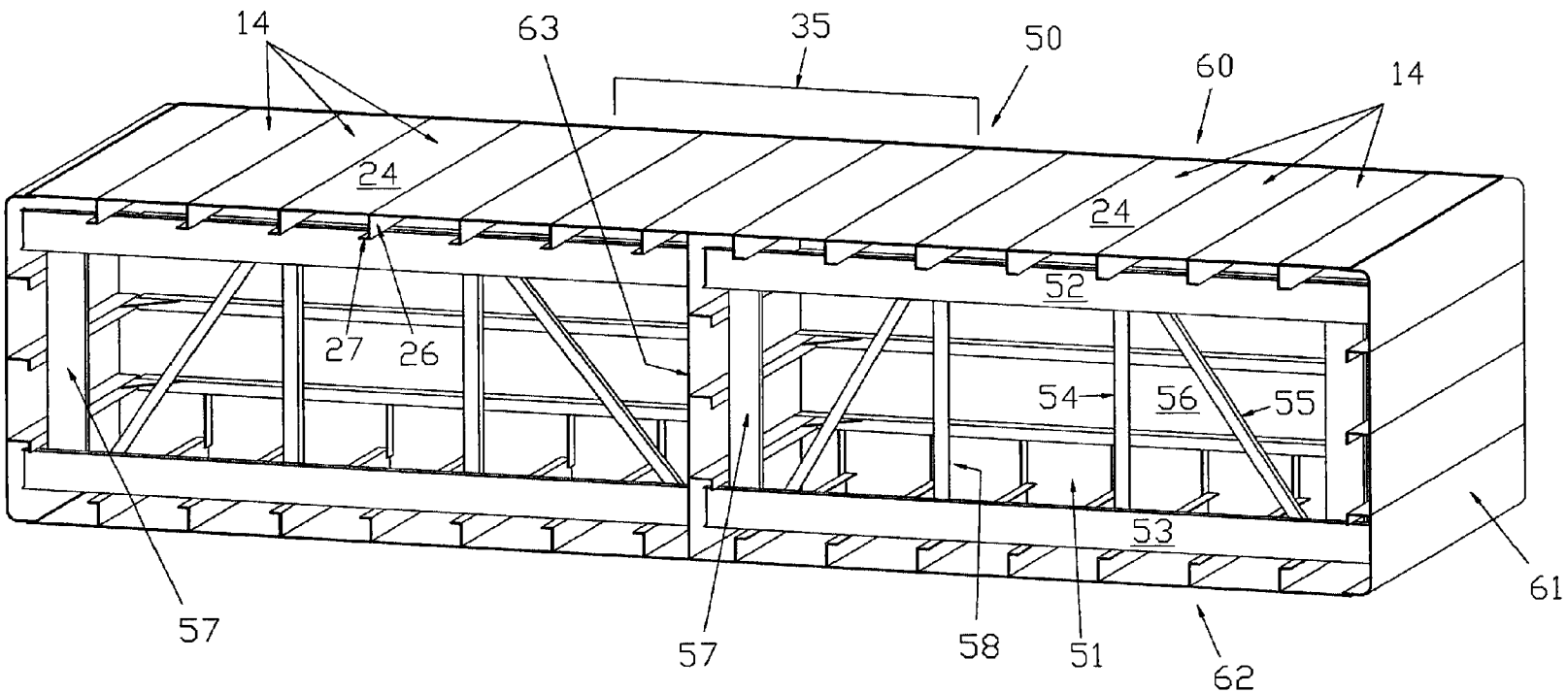
FIG. 11 is an isometric sectional view illustrating panels attached to a barge frame.

FIG. 11 also illustrates a perspective sectional view of an example barge. The barge cross-section (50) shows a vessel frame (51) which defines the primary internal structure of the vessel. In this embodiment, the vessel frame (51) will include longitudinal bulkhead (63), transverse bulkhead (56), and transverse frame (58). Transverse frame (58) is further defined by upper cord (52), lower cord (53), stanchions (54), diagonals (55), and vertical web frames (57). FIG. 11 demonstrates how multi-section panels (35) will be attached to the vessel frame in order to form various hull or deck portions (or sections) of the vessel. For example, FIG. 10 shows deck section (60), side sections (61), bottom section (62), and (longitudinal) bulkhead section (63). Each of these deck or hull sections may be formed of one or more multi-section panels (35). FIG. 11 also illustrates how flat segments (24), web segments (26) and flange segments (27) of the sections (14) are oriented with respect to vessel frame (51). The flange segments (27) of deck section (60) are attached (e.g., by welding) to the upper cords (52) and the flat segments (24) form the surface of the deck. In a similar manner, other multi-section panels attach to bottom cords (53) to form the bottom section (62) and to vertical web frames (57) to form the side sections (61). Naturally, FIG. 11 shows only one example embodiment, but it illustrates one design concept which may be applied to other vessel frames (regardless of vessel type), boxes, containers, living quarters, or any enclosure where it is advantageous to employ the inventive method.

In addition to the embodiments described above, other example embodiments may include the following. Embodiment A is a method of constructing a vessel comprising the steps of: (a) providing a plurality of elongated cold formed metal sections, the sections comprising a flat segment, a web segment, and a flange segment, wherein the flat segment is wider than the flange segment; (b) welding the plurality of sections together to form a multi-section panel; and (c) attaching the multi-section panel to a vessel frame.

This Embodiment A may include variations wherein (i) the metal sections comprise a steel; (ii) the metal sections comprise aluminum or an aluminum alloy; (iii) the metal sections being shaped at least in part through a roll forming process; (iv) the metal sections being placed in a welding fixture aligning the metal sections prior to welding the sections into the multi-section panel; (v) the plurality of sections are welded using a one sided welding operation; (vi) the one sided welding operation being a submerged arc welding process; or (vii) the plurality of sections being welded using a metal inert gas welding process.

Other variations of this Embodiment A may include (viii) the sections having a length between about 20 feet and about 200 feet; (ix) the flat segment having a width ranging between about 12 inches and about 30 inches; (x) the material thickness of the sections ranging between about 1/16 inch and about ¾ inch; (xi) the multi-section panels being attached on the vessel frame as at least two of deck sections, side sections, bottom sections, inner bottom sections, or bulkhead sections; or (xii) the metal sections being shaped at least in part through a press break process.

Another embodiment (Embodiment B) is a method of constructing an external hull, bulkhead, and/or deck panel for a vessel comprising the steps of: (a) providing a coiled section of metal material; (b) cold forming the section of metal material to create a plurality of elongated sections, the sections comprising a flat segment, a web segment, and a flange segment, wherein the flat segment is wider than the flange segment; and (c) welding the plurality of sections together to form a multi-section panel. Embodiment B may include the variations (i) to (xii) detailed above.

An Embodiment C is a method of constructing a panel having integral web and flange support segments comprising the steps of: (a) providing a section of blank metal material; (b) cold forming the section of metal material to create a plurality of elongated sections, the sections comprising a flat segment, a web segment, and a flange segment, wherein the flat segment is wider than the flange segment; and (c) welding the plurality of sections together to form a multi-section panel. Embodiment C may include the variations (i) to (xii) detailed above.

Embodiment D is a vessel constructed with a series of hull, bulkhead, and/or deck panels, the vessel comprising: (a) a vessel frame; (b) a multi-section panel attached to the vessel frame, the multi-section panel comprising a plurality of elongated cold formed steel sections welded together, the sections further comprising a flat segment and a web segment, wherein the flat segment is wider than the web segment; and (c) wherein flange segment is attached to the vessel frame and the flat segment forms a portion of a hull, bulkhead, and/or deck of the vessel. Embodiment D may include the variations (i) to (xii) detailed above.

Embodiment E is a multi-section panel having integral web and flange support segment where the multi-section panel comprises a plurality of elongated cold formed steel sections welded together, the sections further comprising a flat segment, a web segment, and a flange segment, wherein the flat segment is wider than the flange segment. Embodiment E may include the variations (i) to (xii) detailed above.

Embodiment F is an enclosure constructed with a series of multi-section panels, the enclosure comprising: (a) an enclosure frame; (b) multi-section panels attached to the enclosure frame, the multi-section panels each comprising a plurality of elongated cold formed steel sections welded together, the sections further comprising a flat segment, a web segment, and a flange segment, wherein the flat segment is wider than the flange segment; and (c) wherein the flange segments are attached to the enclosure frame and the flat segments form an exterior surface of the enclosure. Embodiment F may include the variations (i) to (xii) detailed above.

Although the above description is in terms of selected embodiments, the present invention may include many modifications and variations of the present figures. And although the above description may state or imply advantages to certain embodiments, none of those advantages are necessarily critical to any particular embodiment and other embodiments not having such advantages are intended to fall within the scope of the present invention. All obvious modifications and variations of the embodiments described above are also intended to come within the scope of the following claims.

We claim:

1. A method of constructing a vessel comprising the steps or:

a. providing a plurality of elongated cold formed steel sections, said sections comprising:
   i. a length between about 20 feet and about 200 feet;
   ii. a thickness between about 1/16 inches and about 3/4 inches;
   ii. a flat segment between about 12 inches and about 30 inches and a web segment,
   wherein said flat segment is wider than said web segment;

b. welding said plurality of sections together along an edge of said flat segments to form a multi-section panel;

c. attaching said multi-section panel to a vessel frame.

2. The method or claim 1, wherein said sections further comprise a flange segment.

3. The method of claim 1, wherein said metal sections are shaped at least in part through a roll forming process.

4. The method of claim 1, wherein said metal sections are shaped at least in part through a press break process.

5. The method of claim 1, wherein said welding step further comprises placing said sections in a welding fixture aligning said sections prior to welding said sections into said multi-section panel.

6. The method of claim 1, wherein said welding step comprises using a one sided welding operation.

7. The method of claim 6, wherein said one sided welding operation is a submerged arc welding process.

8. The method of claim 1, wherein said attaching step comprises attaching said multi-section panels on said vessel frame as at least two of deck sections, side sections, bottom sections, inner bottom sections, or bulkhead sections.

9. The method of claim 2, where said web segment is generally perpendicular to said flat segment and said flange segment is generally parallel to said flat segment.

10. A vessel constructed with a series of hull, bulkhead, and/or deck panels, said vessel comprising:

a. a vessel frame;

b. a multi-section panel attached to said vessel frame, said multi-section panel comprising a plurality of elongated cold formed steel sections welded together, said sections further comprising:
   i. a length between about 20 feet and about 200 feet;
   ii. a thickness between about 1/16 inch and about 3/4 inches;
   ii. a flat segment between about 12 inches and about 30 inches and a web segment,
   wherein said flat segment is wider than said web segment;

e. wherein said sections are welded together along an edge of said flat segments and said multi-panel section is attached to said vessel frame such that said flat segments form a portion of a hull, bulkhead, or deck of said vessel.

11. The vessel of claim 10, wherein said sections further comprise a flange segment and said flange segment is attached to said vessel frame.

12. The vessel of claim 10, wherein a first multi-section panel comprises sections having a first cross-section and forms at least a portion of a deck of said vessel and a second multi-section panel comprises sections having a second cross-section and forms at least a portion of a hull of said vessel.

13. The vessel of claim 10, wherein a first multi-section panel forms at least two of a deck section, a side section, a bottom section an inner bottom section, or a bulkhead section.

14. The vessel of claim 10, wherein said multi-section panels have a width of between about 5 and about 20 feet.

15. The vessel of claim 11, where said web segment is generally perpendicular to said flat segment and said flange segment is generally parallel to said flat segment.

16. A vessel constructed with a series of hull, bulkhead, and/or deck panels, said vessel comprising:

a. a vessel frame;

b. a multi-section panel attached to said vessel tram; said multi-section panel comprising a plurality of elongated metal sections welded together, said sections further comprising:
   i. a length between about 20 feet and about 200 feet;
   ii. a thickness between about 1/16 inches and about 3/4 inches;
   ii. a flat segment between about 12 inches and about 30 inches and a web segment,
   wherein said flat segment is wider than said web segment;

c. wherein said sections are welded together along an edge of said flat segments and said multi-panel section is attached to said vessel frame such that said flat segments form a portion of a hull, bulkhead, or deck or said vessel.

17. The vessel of claim 16, wherein said sections further comprise a flange segment and said flange segment is attached to said vessel frame.

18. The vessel of claim 16, wherein a first multi-section panel comprises sections having a first cross-section and forms at least a portion or a deck of said vessel and a second multi-suction panel comprises sections having a second cross-section and forms at least a portion of a hull of said vessel.

19. The vessel of claim 16, wherein a first multi-section panel forms at least two of a deck section, a side section, a bottom section, an inner bottom section, or a bulkhead section.

20. The vessel of claim 16, wherein the elongate metal sections comprise cold formed steel.

* * * * *